US006490901B2

(12) United States Patent
Potthoff

(10) Patent No.: US 6,490,901 B2
(45) Date of Patent: Dec. 10, 2002

(54) ROLLING UNIT FOR A ROLLING MILL FOR ROLLING OR SIZING METAL PIPES, BARS OR WIRES

(75) Inventor: Heinrich Potthoff, Hilden (DE)

(73) Assignee: Kocks Technik GmH & Co., Hilden (DE)

( * ) Notice: Subject to any disclaimer, the term of this patent is extended or adjusted under 35 U.S.C. 154(b) by 0 days.

(21) Appl. No.: 09/819,322

(22) Filed: Mar. 28, 2001

(65) Prior Publication Data

US 2001/0035037 A1 Nov. 1, 2001

(30) Foreign Application Priority Data

Mar. 28, 2000 (DE) ..... 100 15 340

(51) Int. Cl.[7] ..... B21B 13/10
(52) U.S. Cl. ..... 72/224; 72/235; 72/237
(58) Field of Search ..... 72/224, 235, 237, 72/246, 248, 249

(56) References Cited

U.S. PATENT DOCUMENTS 3,861,187 A * 1/1975 Leeuwestein ..... 72/224
4,313,325 A * 2/1982 Staat et al. ..... 72/224
4,569,217 A * 2/1986 Properzi ..... 72/224
5,144,827 A * 9/1992 Iio ..... 72/224
6,035,685 A * 3/2000 Takai et al. ..... 72/235

FOREIGN PATENT DOCUMENTS

DE 3703756 * 8/1988 ..... 72/224
WO 98/06515 2/1998

* cited by examiner

*Primary Examiner*—Ed Tolan
(74) *Attorney, Agent, or Firm*—Michael J. Striker

(57) ABSTRACT

A rolling unit for a rolling mill for rolling or sizing metal pipes, bars or wires has at least three rolls arranged in a star arrangement. Each roll has a separate drive mechanism and bearings on both sides of the roll. The rolls are adjustable radially with the bearings. A higher load can be borne with smaller outer dimensions. Furthermore the number of individual parts of the rolling unit is reduced as well as manufacturing and assembly expenses for the rolling unit. For this purpose the bearings of the roll shafts are mounted in respective eccentric sleeves, whose rotational position is continuously changed by means of an adjusting device. A securing device is provided however to fix the rolls in one rotational position.

8 Claims, 1 Drawing Sheet

ROLLING UNIT FOR A ROLLING MILL FOR ROLLING OR SIZING METAL PIPES, BARS OR WIRES

BACKGROUND OF THE INVENTION

1. Field of the Invention

The present invention relates to a rolling unit for a rolling mill for rolling or sizing metal pipes, bars or wires having at least three rolls arranged in a star-shaped arrangement around a rolling mill axis, each of which has a separate drive means and is rotatably mounted by means of a roll shaft and bearings arranged on both sides of each roll. Each roll is mounted in a rolling unit housing so that it is radially adjustable in the rolling unit housing.

2. Prior Art

A rolling unit of this type has already been disclosed in WO 98/06515. The rolls there are mounted in built-in components, with which they can be shifted in a radial direction relative to the rolling mill axis within the rolling unit housing. Devices for shifting and holding the built-in components and thus the rolls in a radial direction are arranged in a rolling unit frame, which surrounds the rolling unit housing. The drive units provided for driving the rolls are located outside of the rolling unit frame.

This sort of rolling unit has the disadvantage that its outer dimensions are comparatively large and a considerable amount of space is required for the entire rolling mill. This results, above all, from the arrangement and structure of the adjusting devices for radially adjusting and holding the built-in components. These adjusting devices require much space in a radial direction. Space is required for pre-tensioning means for producing tension arranged between the built-in components and devices for radial adjustment. Thus when no rolled goods are being rolled, there is no plays between these parts. Consequently particularly large outer dimensions are required for the rolling unit frame supporting these devices and the rolling unit housing. The rolling unit frame and the rolling unit housing are of course separate parts in the known structure, but they form a functional unit and form an especially large complete rolling unit only together with the radially adjustable rolls. Since the drive units for the rolls are arranged outside of the rolling unit frame, considerable spacing of the drive units from the roll mill axis exists and thus the rolling mill has considerable dimensions in a radial direction. However the known rolling unit also has a great width in the axial direction, i.e. in the direction of the rolling mill axis, because the built-in components are held in place by swivel pins, which are arranged laterally next to the rolling unit housing. Because of that a large spacing of the rolling units and thus also of the calibrated openings formed by the rolls from each other results, which has the consequence that the length of the unusable thicker end section of the rolled goods is considerably large. Also the waste during production is large.

Furthermore manufacturing expenses are especially high for the known rolling unit, because of the use of built-in components and devices for holding, guiding and radially adjusting the built-in components, which must be made with numerous individual parts and assembled.

Furthermore the known rolling unit has a weak structure because of the numerous individual parts, which give way too much to the forces occurring during rolling. The known rolling unit thus does not maintain the rolls in their provided positions with sufficient accuracy and reliability continuously in the required manner under the currently common high loads produced by the forces on the rolls. Because of that the required narrow tolerances for the rolled goods are not maintained. The flexibility of the known structure toward the forces acting on the rolls is based, above all, on the fact that the built-in components are only held in the structure by swivel pins. Furthermore the forces are conducted through several individual parts and thus over a comparatively long distance, which leads to a comparatively large elastic deformation. Furthermore exact adjustment of the rolls is impaired by wear, which is to be expected in the region of the operating surfaces between the linearly moving devices for radial adjustment of the built-in components and the built-in components that are pivotable on a circular path. Primarily there is a danger that these operating surfaces are temporarily exposed to dirt or dust when the rolling unit housing is removed.

An additional disadvantage of the known rolling unit is that the diameter of the opening formed by the rolls cannot be adjusted and measured when the rolling unit housing is in the workshop. This is because in the workshop the built-in components take arbitrary positions in the rolling unit housing and these can always be changed. In the workshop the built-in components and the rolls are guided of course in a radial direction in the rolling unit housing, however are fixed in no position. The devices for radial adjusting and holding the built-in components and rolls are missing. As already mentioned, these devices are arranged in the rolling unit frame, which is fast attached in the rolling mill, thus they cannot be transported together with the rolling unit housing in the workshop. However when the rolling unit housing is again inserted in the rolling unit frame and thus in the rolling mill, the devices for radial adjustment and holding can operate again. Then the built-in components and the rolls take certain adjustable positions relative to the rolling mill axis. However the position of the rolls and thus the diameter of the opening between them is then not measured in most rolling units, because its rolling unit housing is inside the rolling unit frame. Then the rolls are arranged close to each other in the rolling mill so that only the opening between them in the first and last rolling unit can be reached and measured. Even if the opening between the rolls could be adjusted to the same diameter with special devices in the workshop as it is when adjusted by the devices for radial adjustment and holding of the built-in components and rolls in the rolling mill, this would still not be sufficient if the average position of the rolling unit housing relative to these special devices in the workshop and to the devices for radial adjustment and retention of the built-in components in the rolling mill is not maintained equal or the same with extreme accuracy. Each deviation even with constant diameter of the roll openings leads to an axially incorrect position of the rolls and thus necessarily to sizing errors.

SUMMARY OF THE INVENTION

It is an object of the present invention to provide a rolling unit for a rolling mill for rolling or sizing metal pipes, bars and wires, which does not have the above-described disadvantages, but which allows a stable, but radially adjustable position of the rolls with as small as possible dimensions and comparatively small manufacturing expense.

These objects, and others that will be made more apparent hereinafter, are attained in a rolling unit having at least three rolls arranged in a star configuration or arrangement around the rolling mill axis, each of which has a separate drive means and is rotatably mounted by means of a roll shaft and bearings arranged on both sides of each roll. Each roll is mounted in a rolling unit housing so that it is radially adjustable in the rolling unit housing.

According to the invention this object is attained by a rolling unit of this type in which the bearings for the roll shafts are roller bearings and they are located within eccentric sleeves which are arranged rotatably in bearing passages of a closed one-piece rolling unit housing and in which an adjusting device for continuously changing the rotational position of the eccentric sleeves and a retaining device for holding them fixed in a predetermined rotational position are provided.

The rolling unit according to the invention has a very compact structure with only very small outer dimensions. That is due to the fact that the devices for adjusting and maintaining the rolls comprise eccentric sleeves. The eccentric sleeves, in contrast to the known built-in components, and the devices required for them to adjust and maintain their position, require comparatively little space, so that they can be accommodated entirely within the rolling unit housing. Also the rolling unit housing can be kept comparatively small despite the fact that these devices are housed in it. Furthermore a rolling unit frame is no longer required. Consequently the rolling unit according to the invention has considerably smaller dimensions both in the radial and axial direction than the prior art rolling unit. Also the drive units can be arranged at comparatively shorter distances from the rolling mill axis. A mill train, which has considerably smaller dimensions in all directions and which takes up considerably smaller space than the rolling mill with the prior art rolling unit, results. With the rolling unit according to the invention it is possible to keep the spacing of the rolling units from each other small. Thus the unavoidably thicker end section of the rolled goods is shorter and the production waste is kept smaller than with the prior art rolling unit.

Furthermore the number of individual parts in the rolling unit according to the invention is considerably less than in the prior art rolling unit. This reduces both the amount of work and the costs for manufacture and assembly. With this economical rolling unit with nevertheless adjustable rolls according to the invention it is no longer necessary to avoid using rolling units with adjustable rolls in the rolling mills. Each stand position of the rolling mills can have a rolling unit with adjustable rolls. This better utilizes the rolls.

In addition greater stability results because of the compact structure for the new rolling unit according to the invention. The rolling mill according to the invention can take higher rolling forces. The occurring forces are conducted to the rolling unit housing over the shortest distances so that they are borne directly by it and thus no noteworthy elastic deformations occur. All parts, which are required for adjustment and holding the rolls, are arranged within the rolling unit housing and are thus protected from dirt or dust. The wear of these parts is thereby reduced, which guarantees exact positioning of the rolls over the operating life of the rolling unit.

Since the adjustment of the rolls occurs by rotation of the eccentric sleeves, the expense for the adjusting device, especially the number of its individual parts, can be kept small. The desired and required spacing of the rotation axes of the rolls from the rolling mill axis within their adjustment range is guaranteed by the continuous adjustment. During machining of the working surfaces of the rolls each of these adjustable distances can be designed so that the material loss during subsequent working of the rolls can be maintained especially small and the rolls can be used in an optimal manner. The rotation axes of the rolls can be brought into the correct positions with the eccentric sleeves belonging to the after-worked rolls, so that the diameter of the opening can be measured and adjusted. The latter is always possible also in the workshop, where the rolls take and maintain a predetermined position after its construction. Rolling units with different ideal roll diameters can be used because of the separate drive mechanisms, which means with different spacing of the rotation axes from the rolling mill axis. This allows an especially wide application of the rolls and reduces operating costs.

The eccentric sleeves, the adjusting drive of the rolls and the absence of drive bevel gears in the rolling unit housing permits a one-piece or unified structure for the rolling unit housing with radially adjustable rolls. The rolling unit housing may thus be manufactured with considerably less effort. This is because surfaces of both parts of the prior art rolling unit housing that must be painstakingly machined in several steps as well as the numerous passages for adjusting pins and connecting screws which must be assembled together with the parts can be dispensed with or eliminated in the rolling unit of the invention.

In a preferred embodiment of the rolling unit of the invention two eccentric sleeves are arranged on respective sides of each roll and are spaced from each other and nonrotatably, but releasable, connected with each other by means of a connecting bracket. It is sufficient to fix only one of the two eccentric sleeves of one roll shaft which are arranged on both sides of the corresponding roll, directly in its axial and rotational positions because the other eccentric sleeve is also then held in its rotational and axial positions by means of its connecting bracket. Then during adjustment of the rolls only one of the two eccentric sleeves needs to be rotated since the second eccentric sleeve rotates with it by means of its connection with it by the connecting bracket.

It is particularly advantageous when at least one eccentric sleeve of each roll shaft has a bevel gear or gear segment, with which it engages in a corresponding bevel gear or gear segment of another eccentric sleeve of an adjacent roll shaft. Synchronous radial adjustment of all roll shafts and thus all rolls of a rolling unit is thus possible. If the connecting strap is still used, it is sufficient when the adjusting device only engages a single eccentric sleeve so that the rotational position of all eccentric sleeves can be adjusted to the same extent. For the foregoing purpose it is thus recommended that no bevel gear and no toothed segment should be provided between two neighboring eccentric sleeves of two different roll shafts, but instead they should be simply spaced apart from each other. This simplifies the assembly and first adjustment of the eccentric sleeves.

In a preferred embodiment of the invention each of the roll shafts is divided into two shaft portions and each roll is clamped between the opposing surfaces of two shaft portions, but so that it is releasable. The multi-part structure of the roll shafts allows axial clamping of the rolls between the facing surfaces of the two shaft portions. Because of this structurally weakened connections between the rolls and roll shafts with radially projecting adjusting springs and similar elements on the roll shafts and in the passages of the rolls are avoided. Above all the multi-part structure of the roll shafts permits a rapid exchange of the rolls. Also when the axial clamping force between the shaft portions is relieved, they are only moved slightly apart so that the roll can be taken out in a radial direction from the rolling unit. After that another roll is placed between both shaft portions and clamped there in a radial direction in the rolling unit. Expensive disassembly of the rolling unit housing and/or the bearings of the rolls thus is not necessary. A more rapid exchange of the rolls is possible so that fewer rolling units are out of service, because the preparation time for a new use with the rolling units not in the mill train or rolling mill is short so that they are already available again when the rolling units currently in use must be exchanged. Scarcely more than two sets of the new rolling units are thus required for the rolling mill. Furthermore the rapid and simple roll exchanges make a reworking or re-machining of the rolls in the built-in state and the required special machine for that purpose superfluous, because the rolls can be rapidly taken out of the rolling unit for re-machining in a standard machine. They can also be rapidly put back into the rolling unit.

With the two-part structure for the roll shafts it is advisable that the opposing surfaces of the shaft portions and the rolls have projections and corresponding depressions that engage with each other in a form-locking manner. These projections and depressions are not to be confused with the above-mentioned radially projecting adjusting springs and similar elements, because the common projections and depressions extend in the axial direction and thus do not have the above-described weakening effect. They permit a high torque transfer without relative motion between the rolls and roll shafts.

In general the opposing surfaces of the shaft portions have a smaller diameter than the bearing passage of the rolling unit housing between the rolls and the outer drive mechanism for them. Furthermore it is appropriate that each bearing passage of the rolling unit housing should be dimensioned, or of a size that is, continuously smaller from the outer drive mechanism to the interior of the rolling unit housing or of equal size as the bearing passage in front of it. Because of these size relationships it is possible to construct the shaft portions of the roll shafts, the bearings and eccentric sleeves outside of the rolling unit housing and then to insert them into the rolling unit housing from the drive side. These dimensions decrease or reduce the parts arranged in the one-piece rolling unit housing and simplify their assembly.

In additional embodiments of the invention the adjusting device is arranged on one side of the rolling unit housing and it has a bevel gear, which engages in a bevel gear or toothed segment of one of the eccentric sleeves. This sort of adjusting mechanism is easy to make, economical and can be assembled with little effort.

BRIEF DESCRIPTION OF THE DRAWING

The objects, features and advantages of the invention will now be illustrated in more detail with the aid of the following description of the preferred embodiments, with reference to the accompanying figures in which.

DESCRIPTION OF THE PREFERRED EMBODIMENTS

Figure 1:
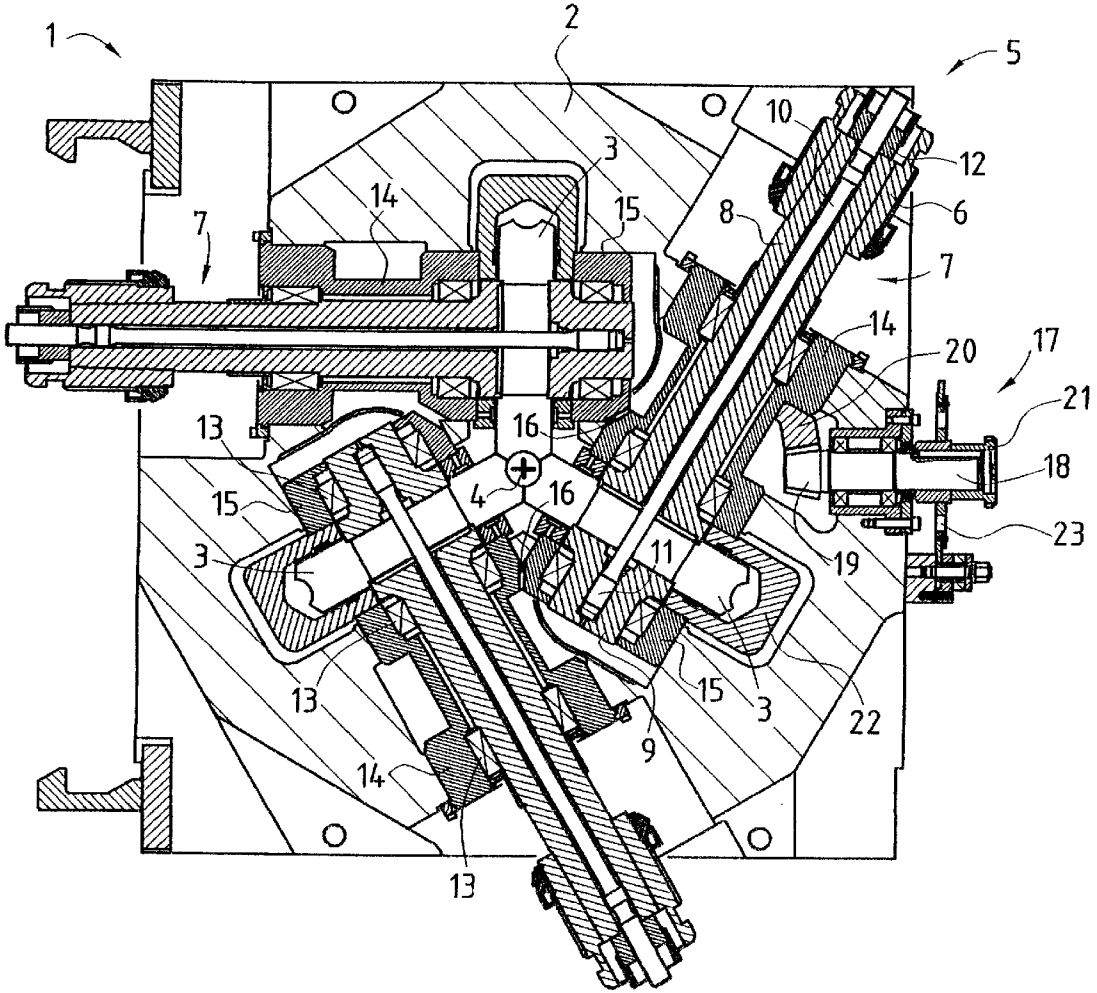
FIG. 1 is a cross-sectional view through a rolling stand according to the invention.

The rolling unit 1 shown in FIG. 1 has a rolling unit housing 2, in which three rolls 3 are arranged in a star, in which the three rolls 3 surround a rolling mill axis 4. Each roll 3 has a separate drive mechanism 5. The separate drive mechanism 5 exerts a drive torque produced by an unshown drive unit on the roll 3. The torque is transmitted to the roll 3 by means of a coupling half 6, which is nonrotatably connected to roll shaft 7.

The roll shafts 7 each comprise two shaft portions 8 and 9. The rolls 3 are clamped between these shaft portions 8 and 9. The required axial force is exerted by a tie rod or tension rod 10, which is screwed into the shaft portion 9 with an end section 11 and which carries a nut 12 on its other end section. The tie rod or tension rod 10 is put under tension by means of known mechanical, hydraulic or pneumatic device acting on the nut 12. The nut 12 is braced on the shaft portion 8. To change the rolls 3 the nut 12 is loosened and the tie rod 10 is relieved of tension. This end section 11 is then screwed out from the shaft portion 9 and the tie rod 10 can be drawn out from the roll 3, so that it can be replaced or exchanged, since both shaft portions 8,9 have been drawn apart from each other. If another roll 3 is placed between opposing surfaces of the shaft portions 8,9, the tie rod is screwed in with its end portion 11 again and after that put under tension again with the help of the nut 12.

Each roll 3 is mounted so that it is rotatable by means of the roll shaft 7 on roller bearings 13 on both sides of the roll. Two roller bearings 13 are arranged in an eccentric sleeve 14 on the driven side of the roll 3, while only one roller bearing 13 is arranged in another eccentric sleeve 15 on the other side of the roll 3. The shorter shaft portion 9 is arranged in this other eccentric sleeve 15.

The other eccentric sleeve 15 of the horizontally extending roll shaft 7 has a bevel gear segment 16, which engages in another such gear segment 16 on the adjacent eccentric sleeve 14. This is also true for the eccentric sleeves 14 and 15 of the roll shafts 7 that are both inclined to the horizontal. Their gear segments 16 are located vertically under the rolling mill axis 4. The eccentric sleeve 14 of the horizontal roll shaft 7 generally has no gear segment 16 and does not mesh or engaged with the adjacent other eccentric sleeve 15. Both these latter eccentric sleeves 14 and 15 have a radial spacing from each other.

An adjusting device 17 with a rotatably mounted shaft 18 and a bevel gear 19 is arranged on a facing surface of the rolling unit housing 2. The bevel gear 19 engages in a toothed part 20 of one of the eccentric sleeves 14. A key for rotation of the shaft 18, the bevel gear 19 and thus also the associated eccentric sleeve 14 via the toothed part 20 can be inserted in a coupling member 21 nonrotatably connected with the shaft 18. This eccentric sleeve 14—like all the eccentric sleeves 14—is spaced from and nonrotatably, but releasably, connected with the other associated eccentric sleeve 15 by means of a connecting bracket 22 that embraces the roll 3. Furthermore the bevel gear segment 16 transmits the rotational motion to the eccentric sleeves 14,15 for all the roll shafts 7. Thus all of the eccentric sleeves 14,15 and with them the rolls 3 are synchronously shifted radially shifted or moved.

Figure 2:
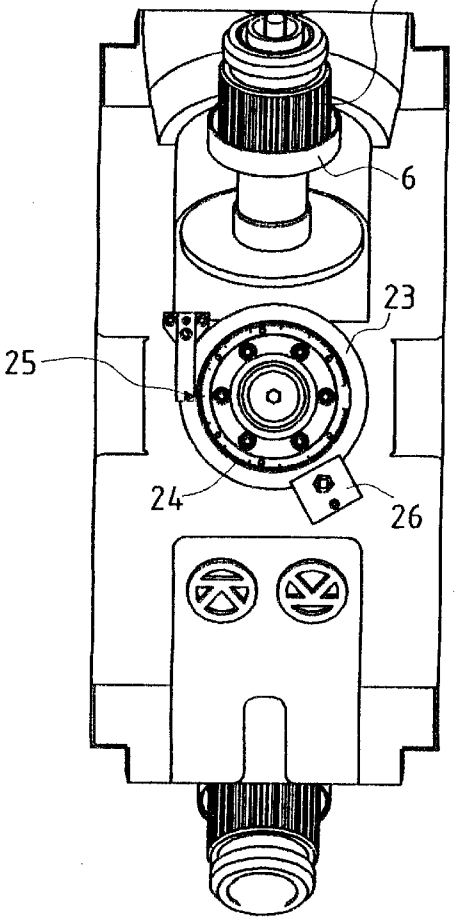
FIG. 2 is a side view of the rolling unit shown in FIG. 1.

FIG. 2 shows that the adjusting device 17 has a disk 23, which is nonrotatably connected with the coupling member 21 and the shaft 18. A scale 24 is provided on the disk 23, which indicates the actual position of the rolls 3 with a pointer 25. A clamping device 26 provides a means for holding the disk 23 fixed at a given position. Then all eccentric sleeves 14,15 and the rolls 3 are held in a predetermined radial position.

FIG. 2 also shows that the coupling half 6 is provided with gear teeth 27, in which an unshown second coupling half of a drive unit engages.

The disclosure in German Patent Application 100 15 340.2 of Mar. 28, 2000 is incorporated here by reference. This German Patent Application describes the invention described hereinabove and claimed in the claims appended hereinbelow and provides the basis for a claim of priority for the instant invention under 35 U.S.C. 119.

While the invention has been illustrated and described as embodied in a rolling unit for a rolling mill for rolling or sizing pipes, bars or wires, it is not intended to be limited to the details shown, since various modifications and changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed is new and is set forth in the following appended claims.

I claim:

1. A rolling unit for a rolling mill for rolling or sizing metal pipes, bars or wires, said rolling unit comprising a rolling unit housing;

at least three rolls arranged on respective roll shafts each divided into two shaft portions and surrounding a rolling mill axis in a star arrangement in the rolling unit housing;

a separate drive mechanism for each of said rolls;

respective eccentric sleeves for said roll shafts arranged rotatably in corresponding respective bearing passages provided in said rolling unit housing;

roller bearings for each of the roll shafts arranged on both sides of each of said rolls within said eccentric sleeves for each of said rolls, so that said rolls are rotatably mounted and radially adjustable in said rolling unit housing;

adjusting means for continuously changing a rotational position of said eccentric sleeves in said rolling unit housing and releasably fixing said eccentric sleeves for each of said rolls in said rotational position, wherein two of said eccentric sleeves are arranged on respective sides of each of said rolls and are spaced from each other and nonrotatably connected with each other by means of a connecting bracket, and said rolling unit housing is a closed one-piece housing; and said connecting brackets connect said eccentric sleeves with one another releasably.

2. The rolling unit as defined in claim 1, wherein at least one of said eccentric sleeves of each of said roll shafts has a bevel gear or gear segment, with which said at least one of said eccentric sleeves engages in a corresponding bevel gear or gear segment of another of said eccentric sleeve of an adjacent one of said roll shafts, and wherein two adjacent ones of said eccentric sleeves of two different ones of said roll shafts have no bevel gear and no gear segment, but instead are radially spaced from each other without engaging with each other.

3. The rolling unit as defined in claim 1, wherein each of said rolls is nonrotatably, but releasably, connected between said two shaft portions of said roll shaft on which said roll is arranged.

4. The rolling unit as defined in claim 3, wherein opposing surfaces of said shaft portions and said rolls held therebetween have depressions and corresponding projections so that said shaft portions and said rolls fit together in a form-locking manner.

5. The rolling unit as defined in claim 1, wherein said adjusting means is arranged on a front or facing side of the rolling unit housing and has a bevel gear and said bevel gear of the adjusting means is engaged with a corresponding bevel gear or gear segment of one of the eccentric sleeves.

6. A rolling unit for a rolling mill for rolling or sizing metal pipes, bars or wires, said rolling unit comprising a closed one-piece rolling unit housing;

at least three rolls arranged on respective roll shafts surrounding a rolling mill axis in a star arrangement in the rolling unit housing;

a separate drive mechanism for each of said rolls;

respective eccentric sleeves for said roll shafts arranged in corresponding respective bearing passages provided in said closed one-piece rolling unit housing;

roller bearings for each of the roll shafts arranged on both sides of each of said rolls within said eccentric sleeves for each of said rolls, so that said rolls are rotatably mounted and radially adjustable in said rolling unit housing;

adjusting means for continuously changing a rotational position of said eccentric sleeves in said rolling unit housing and releasably fixing said eccentric sleeves for each of said rolls in said rotational position, wherein two of said eccentric sleeves are arranged on respective sides of each of said rolls and are spaced from each other and nonrotatably, but releasably, connected with each other by means of a connecting strap, wherein at least one of said eccentric sleeves of each of said roll shafts has a bevel gear or gear segment, with which said at least one of said eccentric sleeves engages in a corresponding bevel gear or gear segment of another of said eccentric sleeve of an adjacent one of said roll shafts, wherein two adjacent ones of said eccentric sleeves of two different ones of said roll shafts have no bevel gear and no gear segment, but instead are radially spaced from each other without engaging with each other.

7. A rolling unit for a rolling mill for rolling or sizing metal pipes, bars or wires, said rolling unit comprising a closed one-piece rolling unit housing;

at least three rolls arranged on respective roll shafts surrounding a rolling mill axis in a star arrangement in the rolling unit housing;

a separate drive mechanism for each of said rolls;

respective eccentric sleeves for said roll shafts arranged in corresponding respective bearing passages provided in said closed one-piece rolling unit housing;

roller bearings for each of the roll shafts arranged on both sides of each of said rolls within said eccentric sleeves for each of said rolls, so that said rolls are rotatably mounted and radially adjustable in said rolling unit housing;

adjusting means for continuously changing a rotational position of said eccentric sleeves in said rolling unit housing and releasably fixing said eccentric sleeves for each of said rolls in said rotational position, wherein each of said roll shafts is divided into two shaft portions and each of said rolls is nonrotatably, but releasably, connected between said two shaft portions of said roll shaft on which said roll is arranged, wherein opposing surfaces of said shaft portions have a smaller diameter than that of the respective bearing passage of the rolling unit housing between said roll and said drive mechanism.

8. A rolling unit for a rolling mill for rolling or sizing metal pipes, bars or wires, said rolling unit comprising a closed one-piece rolling unit housing;

at least three rolls arranged on respective roll shafts surrounding a rolling mill axis in a star arrangement in the rolling unit housing;

a separate drive mechanism for each of said rolls;

respective eccentric sleeves for said roll shafts arranged in corresponding respective bearing passages provided in said closed one-piece rolling unit housing;

roller bearings for each of the roll shafts arranged on both sides of each of said rolls within said eccentric sleeves for each of said rolls, so that said rolls are rotatably mounted and radially adjustable in said rolling unit housing;

adjusting means for continuously changing a rotational position of means for releasably fixing said eccentric sleeves for each of said rolls in said rotational position, wherein said respective bearing passage of the rolling unit housing for the eccentric sleeves is continuously smaller in a direction from the drive mechanism associated therefor to a rolling unit interior or is equal in size with the bearing passage located before said respective bearing passage.

* * * * *